US012624481B1

(12) United States Patent
Trexler et al.

(10) Patent No.: US 12,624,481 B1
(45) Date of Patent: May 12, 2026

(54) FLAME-RESISTANT ELASTIC PLAITED FABRIC

(71) Applicant: Coville, Inc., Winston-Salem, NC (US)

(72) Inventors: Donald W. Trexler, Blowing Rock, NC (US); Tyler J. Henson, Albemarle, NC (US)

(73) Assignee: Coville, Inc., Winston Salem, NC (US)

( * ) Notice: Subject to any disclaimer, the term of this patent is extended or adjusted under 35 U.S.C. 154(b) by 0 days.

(21) Appl. No.: 17/681,006

(22) Filed: Feb. 25, 2022

Related U.S. Application Data

(60) Provisional application No. 63/154,376, filed on Feb. 26, 2021.

(51) Int. Cl.
*D04B 1/18* (2006.01)
*D04B 1/16* (2006.01)

(52) U.S. Cl.
CPC ..... *D04B 1/18* (2013.01); *D04B 1/16* (2013.01); *D10B 2201/22* (2013.01); *D10B 2321/101* (2013.01); *D10B 2331/02* (2013.01); *D10B 2331/021* (2013.01); *D10B 2331/06* (2013.01); *D10B 2331/12* (2013.01); *D10B 2401/021* (2013.01); *D10B 2401/061* (2013.01); *D10B 2501/04* (2013.01)

(58) Field of Classification Search
CPC ..... D04B 1/16; D04B 1/18; D10B 2201/22; D10B 2321/101; D02G 3/32; D02G 3/047
See application file for complete search history.

(56) References Cited

U.S. PATENT DOCUMENTS 3,115,745 A * 12/1963 Lathem ..... D02G 3/322 264/290.5
5,694,981 A * 12/1997 Stanhope ..... A62B 17/003 442/190
2003/0101777 A1* 6/2003 Williams ..... D04B 21/16 66/202
2008/0076312 A1* 3/2008 Gehring ..... D04B 1/16 264/103
2008/0081529 A1* 4/2008 Gehring ..... D04B 21/12 442/304
2008/0227352 A1* 9/2008 Byles ..... D02G 3/443 442/312
2009/0049579 A1* 2/2009 Roberts ..... D04B 1/126 2/81
2013/0212790 A1* 8/2013 Waxman ..... D04B 1/14 428/221
2016/0249685 A1* 9/2016 Blasi ..... A41D 27/28 2/127

OTHER PUBLICATIONS

Horrocks, A. Richard, and Subhash C. Anand, eds. Handbook of technical textiles. Elsevier, 2000, Chapter 10, pp. 223-263 (enclosed). https://rexresearch1.com/TextilesLibrary/HandbookTechnicalTextilesHorrocks.pdf.

* cited by examiner

*Primary Examiner* — Larissa Rowe Emrich
(74) *Attorney, Agent, or Firm* — Nelson Mullins Riley & Scarborough LLP

(57) ABSTRACT

A flame-resistant elastic plaited fabric made of a first yar containing a flame-resistant fiber or a blend of flame-resistant fibers, and a second yarn being an elastomeric yarn covered by a synthetic yarn, wherein the first yarn and the second yarn are plaited in a knitted construction. A method of making and an article are also provided.

12 Claims, 2 Drawing Sheets

FLAME-RESISTANT ELASTIC PLAITED FABRIC

CROSS-REFERENCE TO RELATED APPLICATIONS

This application claims priority from U.S. Provisional Patent Application No. 63/154,376, filed on Feb. 26, 2021, in the United States Patent and Trademark Office. The disclosure of which is incorporated herein by reference in its entirety.

FIELD OF THE INVENTION

The present invention relates to a flame-resistant fabric, in particular to a flame-resistant elastic plaited fabric.

BACKGROUND OF THE INVENTION

Flame resistant and arc rated fabrics are commonplace within occupations that expose employees to hazardous situations involving open flames and arc faults. Most employees that work in such environments are required to wear approved flame/arc protective garments. Most inherently flame-resistant fabrics that meet standards such as ASTM F1506, NFPA 2112, and 70-E tend to be heavy (>7 oz/yd$^2$) and have little to no elastic properties. There are lightweight flame-resistant fabrics on the market but most of them have a topical treatment applied that imparts flame-resistant properties to the fabric. Topical treatments deteriorate as the fabric is washed and therefore destroys the viability of the fabric's protective properties throughout the life of the garment. In addition to the hazardous work environment employees are often required to work in very warm weather with moderate to high physical activity.

The markets current flame-resistant garments tend to increase the wearers body heat due to the bulk and weight of the fabric. Most flame-resistant fabrics with non-elastic properties create loose fitting garments that are prone to snagging.

The flame-resistant garment marketplace needs a long lasting, light weight flame-resistant protective fabric that can be made into a form fitting garment that aids in mobility and comfortability of the wearer. Thus, there is a need for a light weight 7 oz/yd$^2$ or less flame-resistant fabric with elastic properties on the market that is rated for CAT 2 arc flash protection. The fabric of the present invention addresses this need.

SUMMARY OF THE INVENTION

The present invention relates to a flame-resistant elastic plaited textile fabric, method of making, and articles made therefrom.

In an aspect of the invention, a fabric is provided comprising a first yarn comprised of a flame-resistant fiber or a blend of flame-resistant fibers, and a second yarn comprised of an elastomeric yarn covered by a synthetic yarn, wherein the first yarn and the second yarn are plaited in a knitted construction.

In an aspect of the invention, a method of making a flame-resistant elastic plaited fabric is provided. The method comprises plaiting in a knitted construction a first yarn comprised of a flame-resistant fiber or a blend of flame-resistant fibers, and a second yarn comprised of an elastomeric yarn covered by a synthetic yarn.

In an aspect of the invention, an article is provided comprising a first yarn comprised of a flame-resistant fiber or a blend of flame-resistant fibers, and a second yarn comprised of an elastomeric yarn covered by a synthetic yarn, wherein the first yarn and the second yarn are plaited in a knitted construction.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, which are not necessarily to scale, wherein.

DESCRIPTION OF THE PREFERRED EMBODIMENTS

Figure 1:
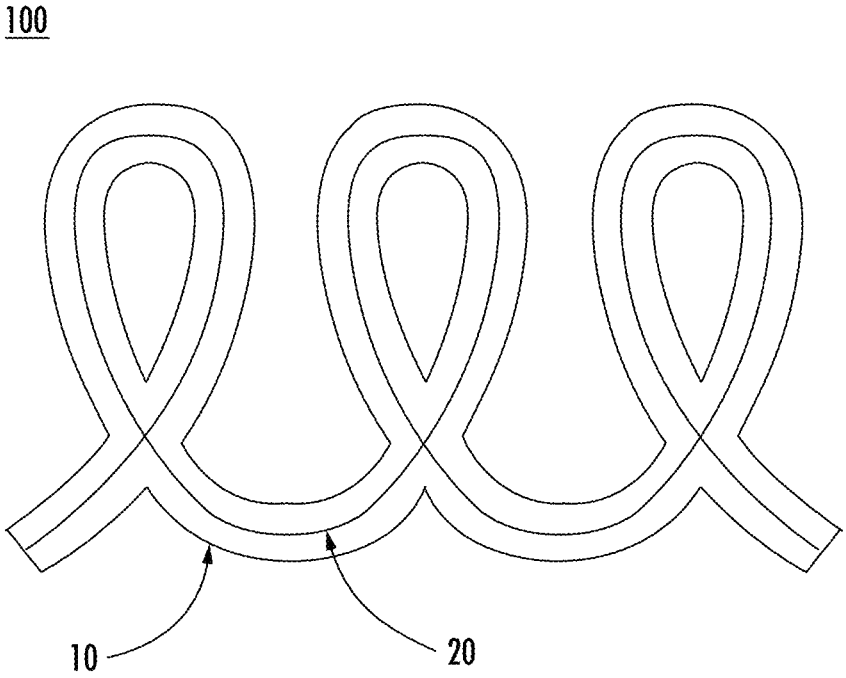
FIG. 1 illustrates a plaited knit construction (single-end/feed) (technical back view).

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in," "at," and/or "on," unless the context clearly indicates otherwise. The phrase "in one embodiment," as used herein does not necessarily refer to the same embodiment, although it may.

This invention relates generally to a textile fabric that utilizes fiber blends to achieve an equilibrium between thermal protection and wearer comfortability. The fabric of the invention has a plaited knit construction. Various embodiments are provided herein.

In an aspect of the invention, the fabric is a flame-resistant elastic plaited fabric comprising a first yarn and a second yarn, wherein the first yarn is different than the second yarn. The first yarn comprises a flame-resistant fiber or a blend of flame-resistant fibers. The term "blend" refers to a combination of different flame-resistant fibers (also referred to as structural components) making up the first yarn. The second yarn is comprised of an elastomeric yarn covered by a synthetic (man-made) yarn. Thus, the first yarn is a spun fiber yarn made of one or more components and the second yarn is comprised of filament fibers.

The first yarn is about 65% to 95%, by weight, of the overall fabric and the first yarn is comprised of at least one flame-resistant polymer selected from the group consisting of modacrylic, cellulosic derivatives, aramid fiber, fluoropolymer, polybenzimidazole, and a copolymer thereof, and/or any combination thereof.

In an aspect of the invention, the first yarn has about 5% to 20% by weight, based on total weight of the yarn blend, of at least one structural fiber component comprising at least one flame-resistant polymer selected from the group consisting of aramid fiber, melamine fiber, carbon fiber, and/or any combination thereof.

The second yarn is about 5% to 35%, by weight, of the overall fabric and the second yarn is comprised of an elastomeric yarn that is conventionally covered (meaning that the synthetic yarn is physically wrapped around the elastomeric yarn) by at least one polymer selected from the group consisting of synthetic fiber groups consisting of aliphatic or semi-aromatic polyamides, polyesters, polyimides, polysulfides, polyurethanes, and copolymers thereof, and/or any combination thereof. Examples of polymers that can be selected for the elastomeric yarn include, but are not limited to, segmented polyurethanes, crosslinked polyacrylates. and nylon-spandex biconstituent fibers, and/or any combination thereof.

In another embodiment of the invention, the first yarn of the fabric may comprise a hydrophobic fiber or a non-hydrophobic fiber. For example, in the case of a hydrophobic fiber, the first yarn of the fabric may comprise about 55% to 75% hydrophobic fiber, wherein percentages are by weight of the yarn blend, and the first yarn of the fabric is comprised of at least one flame-resistant polymer selected from the group consisting of modacrylic, aramid fiber, fluoropolymer, polybenzimidazole, and a copolymer thereof, and/or any combination thereof.

It is contemplated and within the scope of the present invention that more than two yarns can be plaited together.

The fabric of the present invention has a flame-resistant property. The fabric of the present invention is light in weight (meaning 7 oz/yd$^2$ or less). The fabric of the present invention has stretch and exhibits elastic stretch and recovery properties. Among other features, the technical back of the fabric is the face of the garment. The fabric has an UPF 50+ rating such that the fabric protects against harmful UV rays. The fabric of the present invention is dyeable and can be produced in a variety of colors. The fabric of the present invention can be subjected to an antimicrobial treatment to protect against several strands of bacteria.

In an aspect of the invention, a method of making the flame-resistant elastic plaited fabric is provided. The method comprises plaiting the first yarn and the second yarn together in knitting.

In an aspect of the invention, an article is provided such as for use as a garment, personal protective equipment, among other uses, that utilizes fiber blends to achieve an equilibrium between thermal protection and wearer comfortability.

Referring to the figures, FIG. 1 illustrates a plaited knit construction (single-end/feed) 100 (technical back view) in which yarn 1 10 ranges from 40/1's Ne to 28/1's Ne and yarn 2 20 ranges from 20 denier to 200 denier.

Figure 2:
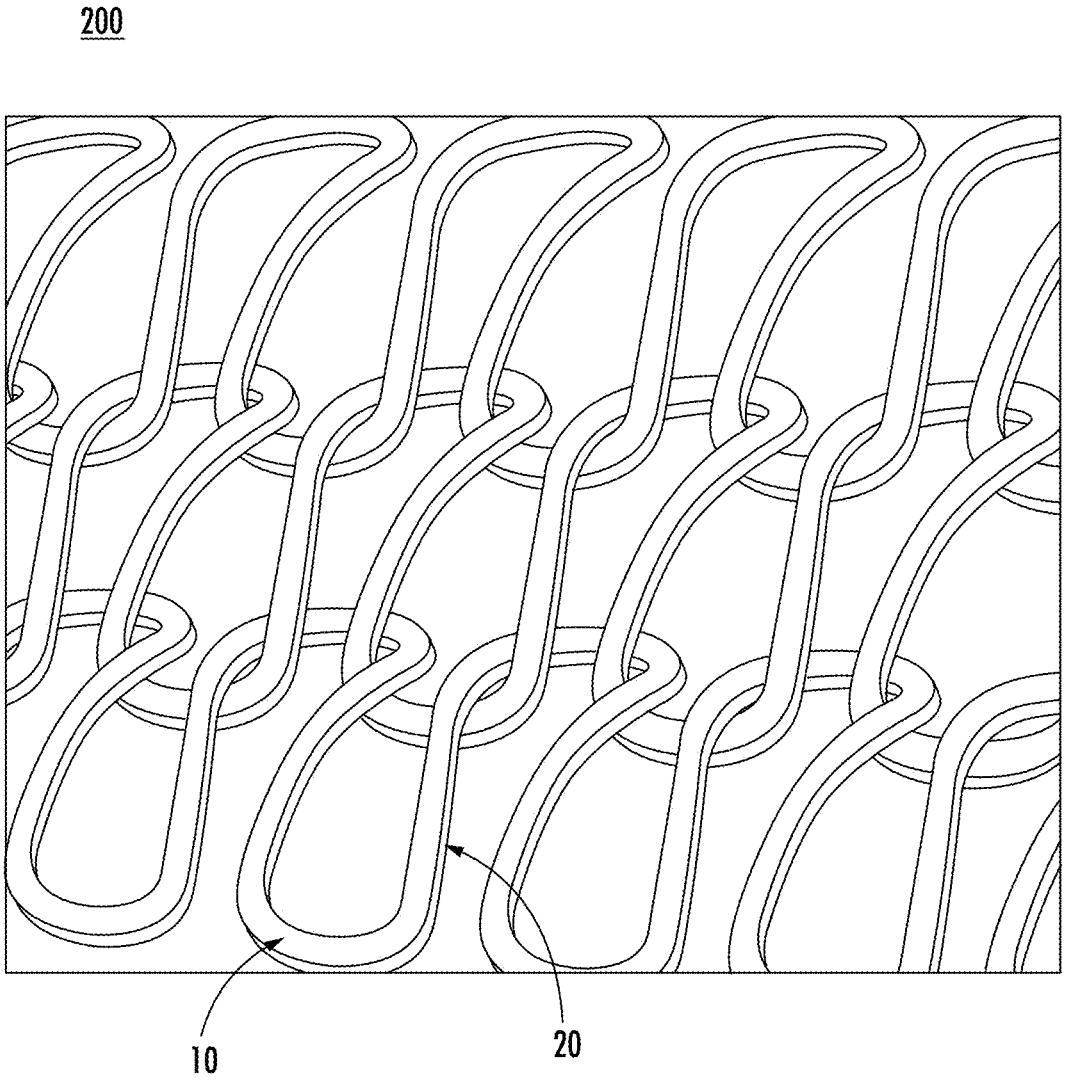
FIG. 2 illustrates a plaited knit construction (fabric).

FIG. 2 illustrates a plaited knit construction (fabric) 200. In FIG. 2, Yarn 1 10 shown is the technical face and Yarn 2 20 shown is the technical back.

Comparative Example

Several samples were tested for the following parameters:

CAT 2 Arc Rating-Min of 8.0 Cal/cm$^2$

ATPV (arc thermal performance value)—measures the incident energy that a material will result in a 50% chance of a second-degree burn by heat transfer EBT (energy breakopen threshold)—measures the incident energy that results in a 50% chance of a material breaking open Both ATPV and EBT are acceptable in measuring arc ratings and hazard assessment as they are both functional equivalents.

HAF (Heat Attenuation Factor)—the amount of heat blocked that a fabric encounters The samples tested were as follows:

Sample 1—Single Knit Jersey—5.77 Oz/Yd$^2$—50% Blue KERMEL® Fiber/50% Black Flame-Resistant (FR) Rayon.

Sample 1 was comprised of a single yarn that was 50% KERMEL® fiber/50% Flame-Resistant (FR) rayon. KERMEL® is a brand of meta-aramid fiber. The construction was a single knit jersey that is specifically knit tight for flame resistant apparel markets. Sample 1 received a 5.5 Cal/cm$^2$ Ebt arc rating.

Fabric properties of Sample 1 were as follows:

5.77 oz/yd$^2$

Tight jersey knit

Single yarn construction

Little to no elastic properties (no elastomeric yarn)

Sample 2—Single Knit Jersey—6.5 Oz/Yd$^2$—50% Modacrylic/35% Cotton/10% Nylon/5% Black KEVLAR® Fiber Sample 2 was comprised of a single yarn that was 50% modacrylic/35% cotton/10% nylon/5% black KEVLAR® fiber. The construction was a single knit jersey that is specifically knit tight for flame-resistant apparel markets. Sample 2 received a 7.6 ATPV Cal/cm$^2$ arc rating.

Fabric properties of Sample 2 were as follows:

6.5 oz/yd$^2$

Tight jersey knit

Single yarn construction

Little to no elastic properties

Sample 3—Plaited Knit Jersey—8.2 Oz/Yd$^2$-77% Modacrylic/12% Flame-Resistant (FR) Rayon/9% Nylon/2% Spandex Sample 3 was comprised of two different yarns.

Yarn 1: 87% Modacrylic/13% Flame-Resistant Rayon

Yarn 2: Nylon 6.6 (86% Nylon 6.6/14% Spandex (Elastomer))

The first yarn was comprised of a modacrylic/FR rayon blend. The second yarn was comprised of a covered spandex yarn resulting in a nylon/spandex blend. The overall fabric blend yielded 72% modacrylic/12% FR rayon/9% nylon and 2% spandex. The construction was a plaited jersey with the second yarn being plaited to the back of the fabric.

Sample 3 received a 5.8 Ebt Cal/cm$^2$ arc rating.

Fabric properties of Sample 3 were as follows:

8.2 oz/yd$^2$

Plaited jersey knit

Back of the fabric was tested as the face

Single yarn construction

High elastic stretch and recovery

Antimicrobial treatment

Sample 4—Plaited Knit Jersey≤6.5 Oz/Yd$^2$-39% Modacrylic/35% FR Rayon/13% Para-Aramid/11% Nylon/2% Elastomer Sample 4 was a fabric in accordance with an embodiment of the present invention. Sample 4 was comprised of two different yarns, Yarn 1 and Yarn 2.

Yarn 1: The first yarn was about 65% to 95% by weight of the fabric. and the flame-resistant fiber was comprised of at least one flame-resistant polymer selected from the group consisting of modacrylic, cellulosic derivatives, aramid fiber, fluoropolymer, polybenzimidazole, and a copolymer thereof, and a combination thereof. The first yarn had about 5% to 20% by weight, based on total weight of the yarn blend, of at least one structural fiber component comprising at least one flame-resistant polymer selected from the group consisting of aramid fiber, melamine fiber, carbon fiber, and/or any combination thereof.

Yarn 2: The second yarn was about 5% to 35%, by weight, of the overall fabric and the second yarn was comprised of an elastomeric yarn that was conventionally covered by at least one polymer selected from the group consisting of synthetic fiber groups consisting of aliphatic or semi-aromatic polyamides, polyesters, polyimides, polysulfides, polyurethanes, and copolymers thereof, and/or any combination thereof.

Yarn 1 was comprised of a modacrylic/FR rayon/para-aramid blend. Yarn 2 was comprised of a covered elastomeric yarn resulting in a nylon/elastomer blend. The overall fabric blend yielded 39% modacrylic/35% FR rayon/13% para-aramid/11% nylon and 2% spandex. The construction was a plaited jersey with the Yarn 2 being plaited to the back of the fabric. Sample 4 received a 8.7 ATPV Cal/cm$^2$ arc rating.

Fabric properties of Sample 4 were as follows:

≤6.5 oz/yd$^2$

Plaited jersey knit

Back of the fabric was tested as the face

Single yarn construction

High elastic stretch and recovery

Antimicrobial treatment

UPF 50+ rated

Based on the test results, it was determined that several parameters must be considered when developing a flame-resistant arc rated fabric. As seen in the above test results, Sample 1 comprised of 100% flame-resistant fibers performed poorly when tested in accordance to ASTM 1959 for determining the fabrics arc rating. The fabric construction, weight, and blend must all be considered when designing flame-resistant protective apparel. Sample 2 was a tightly knit jersey fabric like Sample 1, but added nylon and cotton as its cellulosic to the blend. Sample 2 was 6.5 oz/yd$^2$, which was higher than Sample 1 at 5.77 oz/yd$^2$, but yielded a much high arc rating at 7.6 Cal/cm$^2$ as compared to Sample 1 at 5.5 Cal/cm$^2$. While normally nylon is not desirable in thermal protective fabrics, nylon was actually beneficial at lower levels in the blend. When the nylon was heated up, it melted and filled the gaps between the modacrylic and cellulosic fibers further increasing its thermal protective properties. Both Sample 1 and Sample 2 have very poor elastic properties. Sample 3 was comprised of two separate yarns that yielded an overall blend of 72% modacrylic/12% FR rayon/9% nylon and 2% spandex. The addition of an elastomeric yarn gave Sample 3 excellent stretch and recovery properties. This caused the fabric to yield a poor arc rating (5.8 Cal/cm$^2$), even though the fabric was much heavier than the other samples at 8.2 oz/yd$^2$. Sample 4 was a fabric in accordance with an embodiment of the present invention. Sample 4 was comprised of two separate yarns plaited together that yielded an overall fabric blend of 39% modacrylic/35% FR rayon/13% para-aramid/11% nylon/2% elastomer. This addition of an aramid fiber in combination with the nylon elastomer yarn improved Sample 4's thermal arc flash properties significantly as compared to the previous samples. By plaiting the nylon/elastomeric yarn into the fabric with the modacrylic/FR rayon/para-aramid yarn allowed Sample 4 to have highly elastic properties, be lightweight, and offer protection to a wearer against hazardous high thermal situations.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A fabric comprising:

a first yarn comprises a flame-resistant fiber or a blend of flame-resistant fibers, and a second yarn is an elastomeric yarn covered by a synthetic yarn, and wherein the fabric is constructed of two different yarns, the yarns being the first yarn and the second yarn plaited in a knitted construction, and wherein the fabric is rated for CAT 2 arc flash protection at a weight of 7 oz/yd$^2$ or less.

2. The fabric according to claim 1, wherein the fabric has elastic properties.

3. The fabric according to claim 1, wherein the fabric has a weight of 7 oz/yd$^2$ or less and is flame-resistant with elastic properties.

4. The fabric according to claim 1, wherein the fabric has a weight of 6.5 oz/yd$^2$ or less and is flame-resistant with elastic properties.

5. The fabric according to claim 1, wherein the fabric has a weight of 4 oz/yd$^2$ to 7 oz/yd$^2$ and is flame-resistant with elastic properties.

6. The fabric according to claim 1, wherein the first yarn is about 65% to 95% by weight of the fabric.

7. The fabric according to claim 1, wherein the second yarn is about 9% to 35% by weight of the fabric.

8. The fabric according to claim 1, wherein the flame-resistant fiber comprises at least one flame-resistant polymer selected from the group consisting of modacrylic, cellulosic derivatives, aramid fiber, fluoropolymer, polybenzimidazole, and a copolymer thereof, and a combination thereof.

9. The fabric according to claim 1, wherein the first yarn has about 5% to 20% by weight, based on total weight of the yarn blend, of at least one structural fiber component comprising at least one flame-resistant polymer selected from the group consisting of aramid fiber, melamine fiber, carbon fiber, and/or any combination thereof.

10. The fabric according to claim 1, wherein the first yarn comprising about 55 weight % to 75 weight % hydrophobic fiber.

11. A method of making a flame-resistant elastic plaited fabric, the method comprising:

plaiting two yarns in a knitted construction a first yarn comprising a flame-resistant fiber or a blend of flame-resistant fibers, and a second yarn is an elastomeric yarn covered by a synthetic yarn to form a plaited fabric, and wherein the plaited fabric is rated for CAT 2 arc flash protection at a weight of 7 oz/yd$^2$ or less.

12. An article comprising:

a two-yarn fabric construction comprising: a first yarn comprising a flame-resistant fiber or a blend of flame-resistant fibers, and a second yarn is an elastomeric yarn covered by a synthetic yarn, wherein the first yarn and the second yarn are plaited in a knitted construction, and wherein the two-yarn fabric construction is rated for CAT 2 arc flash protection at a weight of 7 oz/yd$^2$ or less.

* * * * *